United States Patent [19]

Fukuoka et al.

[11] Patent Number: 4,602,966

[45] Date of Patent: Jul. 29, 1986

[54] METHOD FOR IMPROVING THE QUALITY OF CAST INGOT IN CONTINUOUS CASTING

[75] Inventors: Shingoro Fukuoka, Tokyo; Kaisuke Shiroyama, Zama; Sadao Inoue; Kenichiro Muto, both of Ichihara; Katsuhiko Murota, Kameyama, all of Japan

[73] Assignee: The Furukawa Electric Co., Ltd., Tokyo, Japan

[21] Appl. No.: 192,546

[22] Filed: Sep. 30, 1980

[30] Foreign Application Priority Data

Oct. 2, 1979 [JP] Japan ..... 54-127179

[51] Int. Cl.[4] ..... B21B 13/12

[52] U.S. Cl. ..... 148/2; 164/76

[58] Field of Search ..... 148/2; 164/476

[56] References Cited

U.S. PATENT DOCUMENTS 3,729,973 5/1973 Wykes ..... 164/76

*Primary Examiner*—L. Dewayne Rutledge
*Assistant Examiner*—S. Kastler
*Attorney, Agent, or Firm*—Armstrong, Nikaido, Marmelstein & Kubovcik

[57] ABSTRACT

This invention relates to the method and apparatus for improving the cast ingot, cast in a continuous casting equipment which is commonly called a "belt-and-wheel" system wherein a casting wheel and a metallic belt are employed, by applying a light reduction to the cast ingot to give elongation under compressive stress during the process wherein the curvature of the cast ingot changes as the cast ingot travels from the exit of a casting wheel.

More particularly, this invention relates to cast ingot quality improvement method and apparatus in a continuous casting which aims at preventing cracks which were liable to occur on the groove bottom side of the ingot cast by the said continuous process; similarly it also aims at crushing blow holes which tended to concentrate on the groove bottom side the cast ingot.

9 Claims, 6 Drawing Figures

METHOD FOR IMPROVING THE QUALITY OF CAST INGOT IN CONTINUOUS CASTING

BACKGROUND OF THE INVENTION

1. Field of the Invention

This invention relates to the method and apparatus for improving the quality of a cast ingot in a continuous casting process by applying light rolling to the cast ingot in order to prevent cracks which were liable to occur on the groove bottom side of the cast ingot surface, cast during a process wherein the curvature of the cast ingot changes in the belt-and-wheel type continuous casting process.

2. Description of Prior Art

Figure 1:
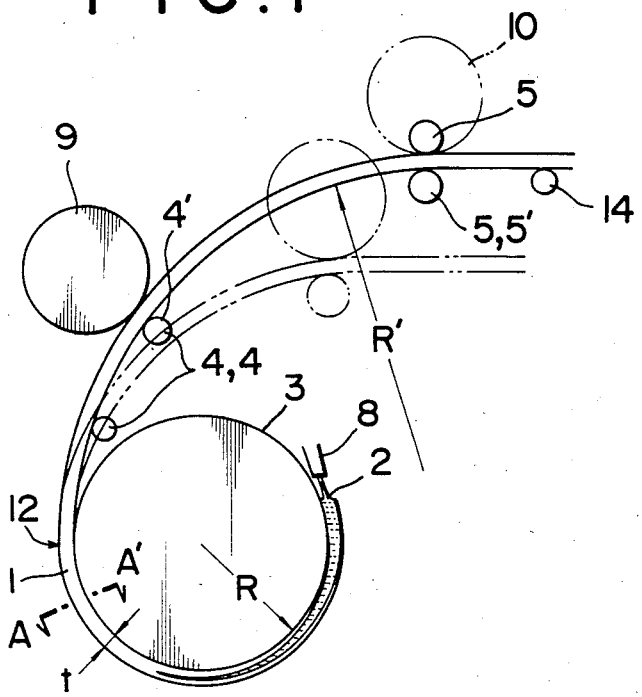
FIG. 1 is the explanatory drawing of a continuous casting process to explain the conventional process and the process covered by this invention.

Referring now to the drawing and particularly to FIG. 1 thereof, there is shown a conventional continuous casting process.

Figure 2:
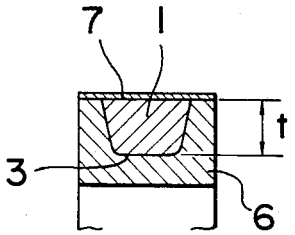
FIG. 2 shows a cut-away cross section along the line A—A' outlined in FIG. 1.

The molten metal (2) which is poured in from spout (8), gradually solidifies in the casting mould (3) which was formed by the casting wheel (6) as indicated in FIG. 2 and the belt (7), along the curvature of circumference of the casting wheel, whereby forming a cast ingot (1) which has the curvature corresponding to the curvature of the circumference of the casting wheel.

This cast ingot (1) is forcibly separated from the casting wheel by a separator at the exit side of the casting wheel (12), the cast ingot being supported by the guide rolls (4), (4) underneath, passing through the pinch rolls (5), (5) located above and beneath, and its position is changed into horizontal direction and is straightened out by its weight and enters into a rolling mill.

In this process, the radius of the curvature of the cast ingot (1) gradually changes, from the radius of the casting wheel (radius from the pivot of the casting wheel) ultimately to the infinity.

Therefore, the groove bottom side (3) of the cast ingot (1) is subject to tensile stress by bending. That is to say, strain t/2R (t is the thickness of cast ingot as shown in FIG. 2) is created by elongation on the groove bottom side.

Figure 3:
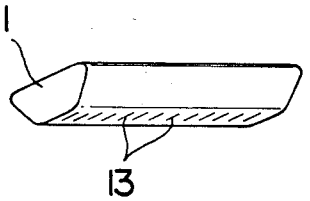
FIG. 3 is a drawing explaining the cracks occurred along the groove side of the ingot cast by the conventional process.

This strain occurs under tensile stress caused by bending, causing cracks (13) to occur frequently on the groove bottom side of the cast ingot (1) (FIG. 3).

As mentioned above, in the continuous casting process, there has been a constant danger of creating defects such as cracks on the groove bottom side of cast ingots. Despite prevailing circumstances, these shortcomings have been overlooked because these cracks had been thought to be improved substantially by selecting the optimum casting variables and also be eliminated by rolling. But these shortcomings are no longer allowed to be overlooked in consideration of the increasing requests for better surface quality of wire rod.

SUMMARY OF THE INVENTION

In view of the foregoing, this invention was accomplished with an aim to prevent cracks on the bottom groove side by avoiding deformation to be caused by tensile stress such as the one shown in the foregoing explanation. More particularly, the invention attempts to prevent cracks by lightly rolling the cast ingot during the process in which the curved cast ingot is subject to back bending as the cast ingot travels from the casting wheel to the rolling mill; preferably bending back the casting ingot by applying reduction during rolling so that the elongation deformation on the groove side of the cast ingot would not occur without restraints thereby improving the process. The invented method will be presented more into details for full understanding in accordance with the examples of preferred embodiment of invention which are indicated in the attached drawings.

As indicated in FIG. 1, since the groove bottom side of the cast ingot is subject to the strain which is expressed by an equation t/2R in total while the cast ingot travels from the exit side of casting wheel (6) to the entrance of a rolling mill. Conventionally, this strain occurs under tensile stress by bending motion, thus causing cracks liable to occur.

Therefore, in the invention, for the purpose of converting the deformation under tensile stress which is caused by bending, into elongation deformation under compressive stress, a pair of rolls with comparable or different diameters have been provided at a location adjacent either to the guide roll (4) or to the pinch roll (5) in order to apply a light reduction rolling on the cast ingot (1). In this instance, if the pair of different diameter rolls are to be used, it will be more effective to use the roll of smaller diameter as it serves to roll the groove bottom side of the cast ingot with increased reduction.

In case of applying a light reduction (light rolling) in a manner mentioned above with the rolls of different diameters, the smaller diameter roll side (groove bottom side) of the cast ingot is rolled more heavily. As a result, elongation becomes larger causing to bend back the curvature of the cast ingot. Since this bending back action is performed by rolling, the elongation is created under the compressive stress during rolling operation, thus reducing the danger of cracks.

As to the above mentioned reduction rolls, the roll (4') is used to replace the conventional guide (4) for the bottom roll (the groove bottom side) and or among pinch rolls (5) (5) for the top and the bottom sides of cast ingot, a roll (5') is used to replace the bottom pinch roll (5). Simultaneously, a new roll either (9) and/or (10) is provided as the top roll (belt side).

Figure 6:
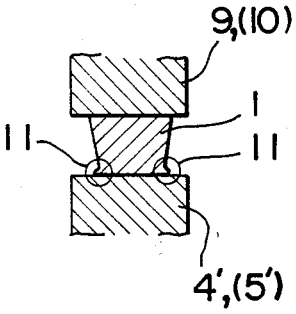
FIG. 6 is a fragmented explanatory drawing showing a localized deformation of an ingot under the reduction roll.

In case of making the roll either (9) or (10), and rolls (4') and/or (5') with different diameters, it would be best to set the diameter ratio within the range of 1:1–6 and to make the larger diameter roll (9) a flat roll, and the small diameter roll (4') or (5') in flat roll or grooved roll. In case there is a danger for the roll of creating cracks due to the localized deformation (11) (FIG. 6), the shapes of the groove of the roll will be made into a configuration that is adequately capable of holding the expanded groove bottom portion of the cast ingot securely.

And the reduction ratio is desired to be set at 1–5 times as much as the elongation strain so that elongation can be created on the groove bottom side of the cast ingot by reduction.

The optimum amount of strain to be bent back differs depending on the position of the reduction roll.

In case of the roll (10), it is possible to change the direction of the cast ingot approximately into horizontal direction by creating elongation which is expressed by an equation t/2R'.

In a location adjacent to the roll (9), since the curvature of circumference is smaller than R', elongation strain necessary for the strain to straighten out the ingot by the roll becomes larger than t/2R'. But, if the cast ingot is bent back by the straight roll (9), it will, on the contrary, be necessary to bend-deform the ingot into opposite direction again, in order to introduce the cast ingot into the guide roll of the rolling mill.

Therefore, while it is considered possible to develop cracks on the surface facing the casting belt if the reduction amount at the roll becomes excessive, there is little danger of cracking so long as the circumferential speeds are synchronizing with each other even though elongation strain created by reduction is deviating from the optimum value because the deformation is produced under compressure stress, nor there is any concern for the narrow adjustment range.

In order to bring the advantage of this invention to the maximum, it is better to have the least back bending amount as possible prior to reduction by roll. Therefore, it is desirable to bring the radius (R') to the initial radius (R) by doing such as lowering the position of said rolls (for light rolling) as shown in the broken line in FIG. 1. In this invention, light rolling which is to be applied between the distance from the exit of the casting wheel to the entrance of rolling mill will usually be performed by one stand rolling mill. This rolling can be performed by rolling mills of more than one stand. It would be better to lightly roll the cast ingot with the total reduction ratio within the range of 0.5%–15%.

It would be preferable to roll with the reduction ratio of 1–10%, and it will furthermore be preferable to perform rolling with the reduction ratio of 2–5%. As to the location of rolling, it would be desirable to perform rolling with reduction ratio within this range at a location as near as possible to the exit (12) of the casting wheel.

Upon working this invention, the temperature of the exit of the cast ingot at the casting wheel should not be too high nor too low, as the too high or the too low the temperature will only serve to aggravate cracking, it would be best to control the temperature within the range of temperatures expressed in an equation. $(0.58\text{–}0.94)\times T_M$(°K.) ($T_M$ is the melting point.)

The advantages of this invention can be summarized in the following listing:

(1) Cracks which have conventionally been liable to occur on the groove bottom side of the cast ingot can be prevented, and (2) Since the blow holes which have been liable to concentrate in the groove bottom portion of the ingot are crushed by this light rolling, the density of the cast ingot becomes higher thus causing to improve the quality from the standpoint of density.

DETAILED DESCRIPTION OF PRIOR ART

Embodiment example 1

In the production of tough pitch copper redraw copper wire, when the casting temperature was 1,150° C., the temperature of cast ingot at the exit was 900° C., the radius of a casting wheel up to the groove bottom was 1,250 mm and the height of the cast ingot was 50 mm, back bending corrective strain became to be t/2R=50/2,500 (=0.02). In this case, at the position quite adjacent to the guide roll, a flat roll (diameter: 400 mm) was provided at the left side and a grooved roll (diameter: 100 mm) was also provided at the groove bottom side and light rolling was applied to the cast ingot with reduction ratio of approximately 4%.

Figure 4:
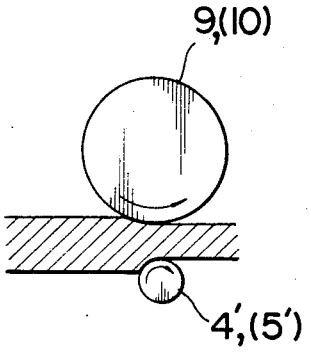
FIG. 4 is a drawing explaining the rolling condition by use of a roll with a different diameter shown in the embodiment example of this invention.
Figure 5:
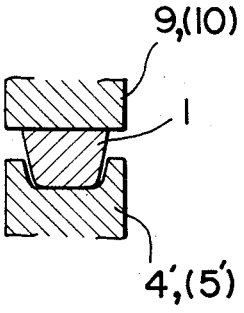
FIG. 5 illustrates a smaller diameter grooved roll as indicated in FIG. 4.

The reduction amount was 2 mm in total, but it was observed that 0.5 mm had been reduced on the larger diameter roll side, and 1.5 mm had been reduced on the smaller diameter roll side (FIGS. 4 and 5).

As a result of casting the ingot with the casting speed of 27 cm/sec. with the circumferential speed of 27 cm/sec. at the casting wheel, no cracks were observed at the groove bottom side of the cast ingot. And blow holes concentrated on the grooved bottom side were crushed and the density was increased to 8.83 g/cm$^3$ by the light rolling from the density of 8.75 g/cm$^3$ which would normally have been obtained conventionally if light rolling had not been performed. The quality was improved from the standpoint of density.

The results of conducting eddy current inspection after rolling the cast ingot with a horizontal roll and a vertical roll indicated that, despite the face that it had been normal that cracks of more than 2 mm in depth had been detected twice and cracks in the range of 2 mm–1 mm had been detected 6 times per coil from the casting ingot which had not been rolled lightly, the detection of the scratches of these two categories had been drastically reduced to 0 and 1 times respectively upon checking the wire from lightly rolled ingot. The diameter of the rod used in the example was about 38 mm and the weight of coil was about 3 tons. Furthermore, the results of eddy current inspection conducted at the final stand of production line of wire rod of 8 mm in diameter at the down stream of process revealed that, despite the fact that scratches of more than 0.5 mm had conventionally been detected twice and cracks in the range of 0.5 mm–1.0 mm had conventionally been detected 8 times per coil from the cast ingot which had not been lightly rolled, the cracks of both categories had drastically been reduced to 0 to 4 times respectively.

The shape of the smaller diameter roll is made in a grooved roll as shown in FIG. 5. The clearance between this grooved roll and the cast ingot was kept as small as 2.5 mm in order to restrain the bottom part of the cast ingot from excessive lateral spread by the reduction applied on the cast ingot.

Embodiment example 2

In the production of aluminum redraw wire, when the casting temperature was 730° C., the temperature of cast ingot at the exit of casting wheel was 530° C., the radius of the casting wheel up to the bottom of groove was 750 mm, the height of a cast ingot was 40 mm, the back bending corrective strain became to be t/2R=40/750 (=0.53).

Therefore, in place of pinch rolls, a flat roll (diameter: 300 mm) was provided as the larger diameter roll on the side of the belt, a grooved roll (diameter: 100 mm) was provided as the smaller diameter roll on the groove bottom side and light rolling was applied with a reduction ratio of approximately 10%.

The reduction amount was about 4 mm in total, but it was observed that approximately 1.5 mm had been reached on the larger diameter roll side, and approximately 2.5 mm had been reduced on the smaller diameter roll side. As a result of casting the ingot at the casting speed of 20 cm/sec. with the circumferential speed of the casting wheel of 20 cm/sec., no cracks were observed at the groove bottom side of the cast ingot.

The shape of the roll was the same as the one indicated in Embodiment example 1.

Furthermore, the results of eddy current inspection conducted at the last stage of producing redraw wire, was despite the fact that scratches of more than 1.0 mm had been detected twice and scratches in the range of 1.0 mm–0.1 mm in depth had been detected in the wire rod of 9.5 mm in outer diameter made from the cast ingot not lightly rolled, the scratches of both categories had been drastically reduced to 0 and 3 times respectively.

Embodiment example 3

In the production of steel wire, when the casting temperature was 1,600° C., the temperature of the cast ingot at the exit was 1,300° C., the radius of the casting wheel up to the groove bottom side was 1,800 mm, and the height of the cast ingot was 50 mm, back bending corrective strain became to be 0.014 as in the case of Embodiment example 1, light rolling was applied to the cast ingot in the same manner as in the case of Embodiment example 1, with the reduction ratio of 2%.

No cracks were observed in groove bottom side of cast ingot made with the same production conditions as those of Embodiment example 1.

We claim:

1. In a continuous casting process including casting a continuous metal ingot by feeding molten metal to a concave groove along the circumferential surface of a rotating casting wheel which is covered by a metallic belt contacting the circumferential surface of the wheel, and continuously, directly feeding the ingot thus cast to a rolling process having a plurality of rolling reduction steps, the improvement comprising the step of straightening the curvature of the cast ingot produced by the casting step prior to feeding the ingot to the rolling process by lightly rolling the cast ingot to reform the curvature thereof by elongating the ingot under reduction.

2. The improvement as claimed in claim 1, wherein the step of lightly rolling includes providing greater reduction to a groove bottom side of the cast ingot than to a metallic belt side.

3. The improvement as claimed in claim 2, wherein the step of providing greater reduction to the groove bottom side comprises rolling the cast ingot between a larger diameter roll on the metallic belt side and a smaller diameter roll on the groove bottom side whereby the groove bottom side is elongated more than the metallic belt side of the ingot thereby straightening the curvature of the ingot.

4. The improvement as claimed in claim 3, wherein the diameter ratio of the larger diameter roll to the smaller diameter roll is from 1:1 to 1:6 and the reduction ratio is from 1–5 times the strain of t/2R, t being a depth of the groove in the casting wheel and R being the radius of the casting wheel up to the groove bottom.

5. The improvement as claimed in claim 1, wherein the amount of reduction is from 0.5 to 15 percent.

6. The improvement as claimed in claim 5, wherein the amount of reduction is from 1 to 10 percent.

7. The improvement as claimed in claim 6, wherein the amount of reduction is from 2 to 5 percent.

8. The improvement as claimed in claim 1, further comprising minimizing the distance of travel of the cast ingot from the casting wheel prior to lightly rolling.

9. The improvement as claimed in claim 1, further comprising controlling the temperature of the cast ingot at the point of exiting the casting wheel to be from 0.58 to 0.94 times the melting point (°K.) of the metal.

* * * * *